US005636650A

United States Patent [19]

Kroeze

[11] Patent Number: 5,636,650

[45] Date of Patent: Jun. 10, 1997

[54] ADJUSTABLE CANE WITH BUILT-IN PICKUP MEANS

[76] Inventor: Steven H. Kroeze, 12603 E. 206th St., Lakewood, Calif. 90715

[21] Appl. No.: 644,532

[22] Filed: May 10, 1996

[51] Int. Cl.[6] ..... A45B 3/00

[52] U.S. Cl. ..... 135/66; 135/70; 135/77

[58] Field of Search ..... 135/65, 66, 75, 135/77, 80, 70

[56] References Cited

U.S. PATENT DOCUMENTS

| | | | |
|---|---|---|---|
| 2,346,038 | 4/1944 | Mason . | |
| 3,467,116 | 9/1969 | Ringewaldt . | |
| 3,763,872 | 10/1973 | Gooley . | |
| 3,768,495 | 10/1973 | Smith | 135/69 X |
| 4,044,784 | 8/1977 | Smith | 135/65 X |
| 4,085,763 | 4/1978 | Thomas | 135/69 |
| 4,299,246 | 11/1981 | Marsh . | |
| 4,811,750 | 3/1989 | McAllister . | |
| 4,827,956 | 5/1989 | Toot . | |
| 5,176,160 | 1/1993 | Odborn . | |
| 5,392,800 | 2/1995 | Sergi . | |
| 5,433,234 | 7/1995 | Lapere | 135/66 |

FOREIGN PATENT DOCUMENTS

| | | | |
|---|---|---|---|
| 2342679 | 9/1977 | France | 135/66 |

*Primary Examiner*—Lanna Mai
*Attorney, Agent, or Firm*—James G. O'Neill

[57] ABSTRACT

A cane having a handle, and a trigger means slidably held in a hollow body of the cane adjacent to the handle. An upper portion of the cane is telescopically mounted in a lower portion so as to adjust the length of the cane, and the slidable trigger means is actuated so as to rotatably move a holding arm outwardly from a slotted opening within a hollow bottom portion of the cane, towards a support foot of the cane to pick up remote objects.

15 Claims, 1 Drawing Sheet

ADJUSTABLE CANE WITH BUILT-IN PICKUP MEANS

BACKGROUND OF THE INVENTION

1. Field of the Invention

This invention relates generally to canes, and more particularly, to a an adjustable cane having a pickup means built into it.

2. Description of Related Art

Canes are well known for helping a user to walk and support themselves in an erect position. However, many people who use canes are afflicted with some type of ailment or have other debilitating conditions that make it difficult or impossible for these people to bend over or stoop to pick up an object that might be on a floor or other surface. Therefore, many persons using a cane who have some type of debilitating condition have problems picking up such items as coins, keys, and the like, which might be dropped, or which might be on a lowered surface. There, therefore, is a long felt need in the art for a cane with some type of pickup means to enable a person who has problems bending or stooping to pick up small items with the cane.

One such prior art device is shown in U.S. Pat. No. 5,392,800 to Sergi, which discloses a multi-use cane device that has a remote object gripping mechanism, a shoehorn, and a rod providing a righting means for the cane if it is dropped to the floor. The remote object gripping mechanism has a trigger, a gripping claw and a connecting linkage of cable. The trigger is mounted on the cane adjacent the handle and is actuated to move the cable mounted inside the cane to move the gripping claw toward and away from a support foot of the cane. The gripping claw and support foot co-acting together allow the user of the cane to grip and manipulate remote objects without the user needing to stoop. However, the gripping claw of this cane is mounted exteriorly of the cane and may cause problems if it is caught upon or contacts another item while a person is attempting to walk, or could contact the ground at the tip when rotated while walking, thereby causing an unstable situation. Furthermore, the actuating trigger of the gripping claw rotates so as to allow another or inner portion of the trigger to extend outwardly from the cane while moving the gripping claw. Therefore, there is a need in the art for a more streamlined, easy to actuate device, which does not have protruding claws or other portions of the trigger means which could catch on or cause harm to other persons or items.

A further prior art device is shown in U.S. Pat. No. 5,176,160 to Osborn, which shows a combination cane and reaching apparatus mounted on the exterior of a cane body. A trigger portion is secured to the cane body adjacent to the handle, while a jaw portion is secured to the cane body adjacent to the cane tip. A cable or string segment connects the trigger element and jaw element on the exterior of the cane whereby on actuation of the trigger, the jaw portion is moved away from the cane tip. The jaw portion also includes an external spring element secured between the jaw portion and a point on the exterior of the cane. Because of the mounting of the trigger, connecting cable or string, the jaw element and the spring element on the outside of the cane, this cane also has problems in use because it might come into contact with or become entangled in other elements which it contacts.

Other canes or walking sticks having pickup means associated therewith are shown in U.S. Pat. No. 3,467,116 to Ringewaldt; U.S. Pat. No. 3,763,872 to Gooley; U.S. Pat. No. 4,299,246 to Marsh; U.S. Pat. No. 4,811,750 to McAllister; and U.S. Pat. No. 4,827,956 to Toot. These patents, however, also experience the same problems set forth above in connection with the patents to Sergi and Osborn, and have further problems themselves that have not been overcome. There, therefore, exists a need in the art for a streamlined, easy to use and manufacture, adjustable cane usable by a variety of different people, and which cane has a pickup means at the end thereof allowing such persons to grip and/or manipulate remote objects, without the need to bend or stoop.

SUMMARY OF THE INVENTION

Accordingly, it is a general object of the present invention to provide an improved combination cane and pickup means. It is a particular object of the present invention to provide an improved and low cost adjustable cane means having a pickup means at one end thereof. It is a still more particular object of the present invention to provide an improved combination cane and pickup means in which the cane is adjustable in length, and the pickup means is held entirely within the body of the cane when not in use. It is a still more particular object of the present invention to provide an improved combination cane and pickup means that helps support a user in an erect walking position, and that further provides a remote object gripping mechanism, completely held within the cane itself, to enable a user to hold and manipulate a retrievable object without having to stoop or bend. And, it is a final particular object of the present invention to provide an adjustable cane having a trigger means mounted on one end thereof to operate a gripping means rotatably secured entirely within the cane, at an opposite end to grip or pick up remote objects.

In accordance with one aspect of the present invention there is provided an improved combination adjustable cane and pickup means assembly having a slidable trigger mounted on the exterior of a hollow housing portion and connected internally of the housing by a cable or string to operate a gripping means held within a hollow housing portion adjacent the other end thereof.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, wherein like reference numerals are used throughout the several views, and, in which:

DESCRIPTION OF THE PREFERRED EMBODIMENTS

Figure 1:
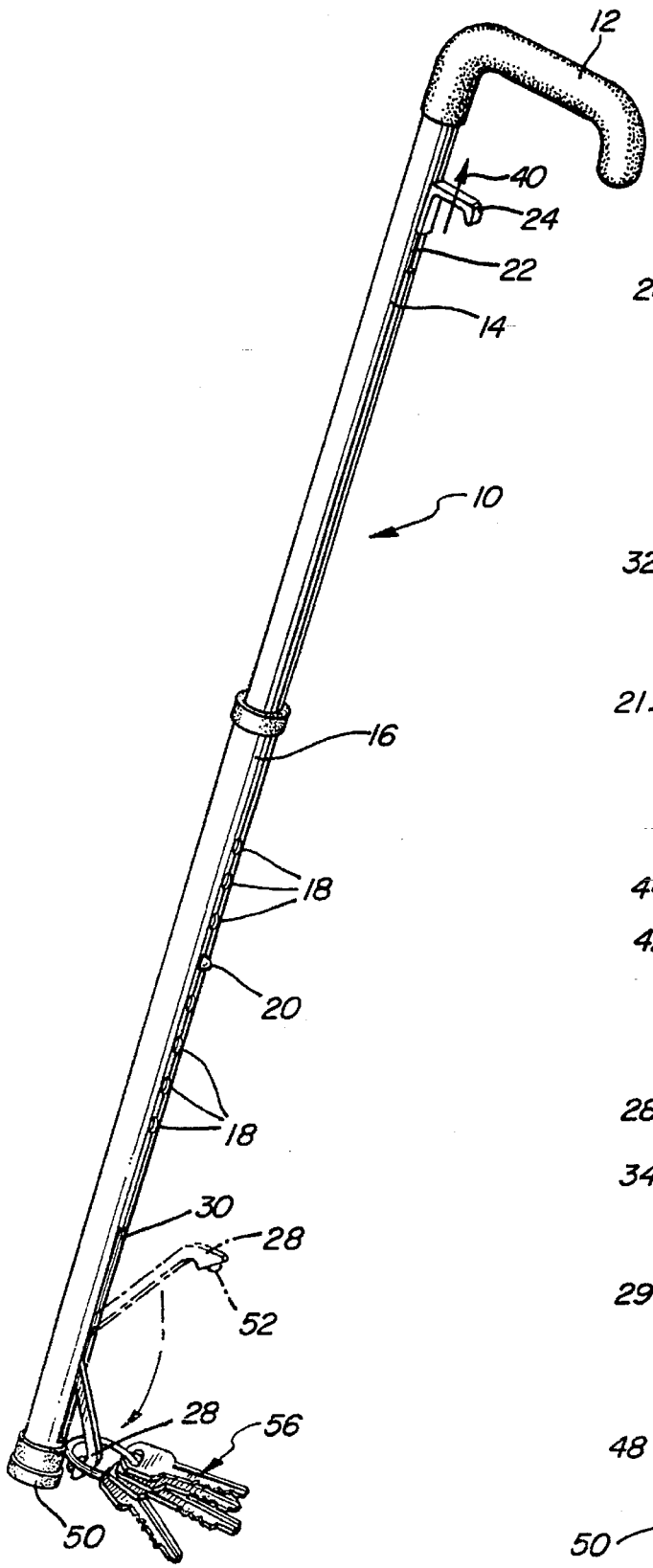
FIG. 1 is a perspective view of a combination cane and pickup means of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved, adjustable cane and gripping means assembly generally indicated at 10.

The cane assembly 10 comprises a top or handle portion 12, secured to an elongated tubular, hollow top body portion 14, telescopically mounted within an elongated tubular, hollow lower body portion 16. A plurality of openings 18 are provided in the elongated hollow lower portion 16 whereby a button 20, biased by a spring means 21 is movably secured interiorly of the hollow inner portion of upper body portion 14. The button 20 may be selectively pressed inwardly and the bottom and top body portions 14, 16 moved with respect to each other so that the button 20 extends through a further opening 18, to adjust the overall length of the cane, in a manner well known to those skilled in the art. The bottom hollow portion 16, and/or the top hollow portion 14 also preferably include means added or formed therein to prevent the bottom and top portions from being rotated with respect to each other and from being pulled apart. Such means could comprise extending lip portions, or the respective portions could be provided with a key and keyway system, or the like.

Figure 2:
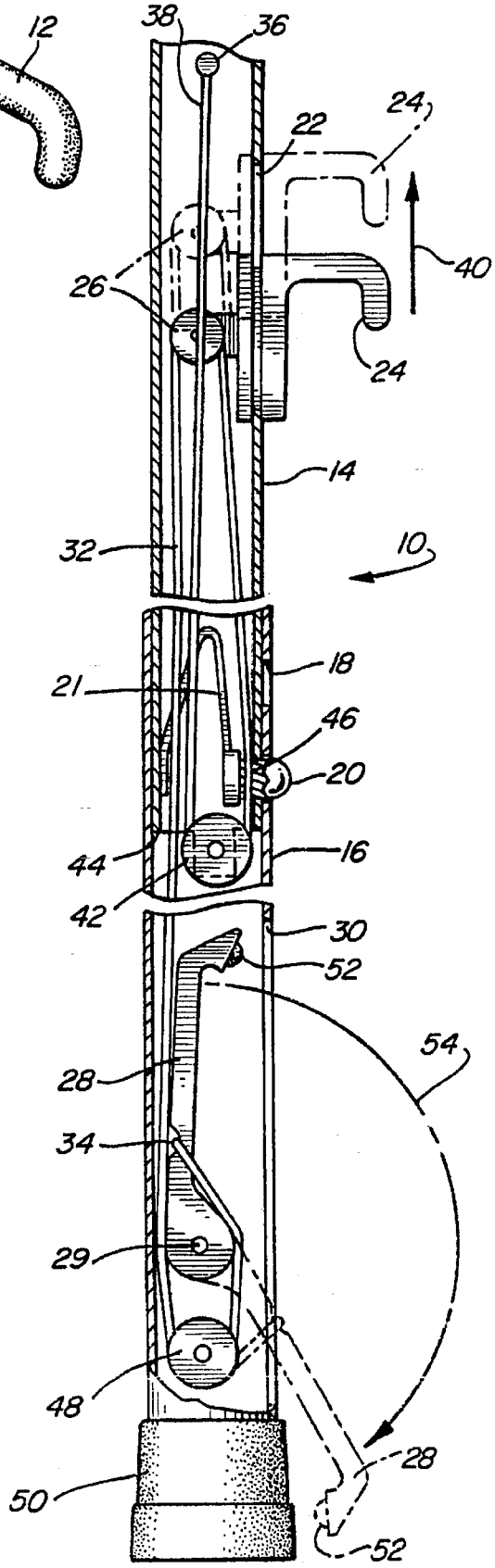
FIG. 2 is a partial cross sectional view of the hollow adjustable cane and pickup means of FIG. 1.

The upper hollow body portion 14 is preferably provided with a slotted opening 22 having a reciprocating trigger means 24 mounted therein. The trigger means 24 includes a first or upper pulley means 26 rotatably mounted on a portion thereof within the hollow upper portion 14. The trigger element is slidable between the solid and broken line positions shown in FIG. 2, to move the pulley 26 and actuate a gripping element 28, as described more fully below.

The trigger means 24 is connected to the gripping means 28, such as a lever arm or finger, rotatably mounted about a pivot 29, within the hollow lower body portion 16, so as to be rotatable in and out of the lower body portion 16, through a further slotted opening 30 formed therein. The trigger 24 and lever arm 28 are preferably connected together by a connecting means 32, such as a string or cable, connected at a first end 34 to the lever arm 28 and secured internally of the upper hollow body portion 14, at a securing means 36 at another or second end 38. The connecting means 32 is preferably non-stretchable along the majority of its length, but should include a stretchable element or portion therein, adjacent to end 38. That is, at least a portion of the cable or string attached to or near the securing means 36 is comprised of an elastomer or stretchable type material to allow for adjustability of the connecting means when the cane is lengthened or shortened, as described above.

In order to operate the cane gripping means 28, the trigger 24 is slid in the direction of arrow 40, and the connecting means 32, attached between the trigger and gripping means within the hollow upper and lower portion 14, 16, moves the gripping means. The connecting means 32 is preferably connected as follows: second end 38 is secured to securing means 36 and extends from the upper portion 14 of the cane toward the lower portion 16 and around a middle or second pulley means 42 secured to an end 44 of the hollow upper body 14, adjacent the spring biased button 20. The connecting means 32 then extends upwardly, through an opening 46 formed through spring biased button 20 and up around the first pulley 26 so as to again extend back down through both the upper and lower hollow bodies and around a further pulley means 48 secured internally within a lower portion of the lower body portion 16, below the pivot 29 of lever arm 28, adjacent a support foot 50 secured to the lower end of the lower body portion 16. After traveling around pulley 48, the connecting means 32 continues until it is secured at its second end 34 to lever arm 28, in any convenient manner.

The operation of the pickup means of the cane 10 of the present invention will now be described. Upon actuation or sliding of the trigger 24, in the direction of the arrow 40, the attached first pulley 26 will be moved upwardly from the solid to the broken line position shown in FIG. 2. This movement will move the connecting 32 secured around this pulley 26 and in opening 46 through button 20 pressed against the interior surface of upper tubular member 14, so as to flip or rotate the lever arm or finger 28 outwardly, through slot 30, from the interior of the hollow lower portion 16, in the direction of the arrow 54, to a position where an outer soft tip 52 of the lever arm may contact the foot support 50. If a small item, such as a coin, or a set of keys 56 (see FIG. 1) is lying on a surface, or other area that may be reached by the cane, the lever arm 28 will capture the keys between its soft tip 52 and the foot support 50 so as to enable a user of the cane to pick up the keys, or other object remote from the handle end 12 of the cane. Furthermore, the hooked end portion of the lever arm 28, allows the cane to snag items with loops, such as shoe laces.

Turning again to FIG. 2, it should be noted that upon adjustment of the length of the cane, by telescoping the upper tubular body portion 14 into and out of the lower tubular body portion 16, upon actuation of the button 20 inwardly against the spring bias 21, the elastomer or stretchable upper portion of the cable or string adjacent the attached first end 38 will either be stretched outwardly from, or retracted toward, securing means 36. After the button 20 is released, and secured within a further opening 18, the cable or string 32 passing through opening 46 in the body of button 20 will again be held against the internal surface of the hollow tubular interior of upper body portion 14 to retain the string or cable in position.

It, therefore, can be seen that the present invention provides a new and improved telescopingly adjustable cane that can be manufactured in a low cost manner, and which also includes an internally mounted pickup means actuable by a trigger means, slidably mounted in an upper portion of the cane, adjacent the handle end thereof, so as to rotatably actuate a lever arm entirely internally mounted within the lower portion of the cane, outwardly against a support foot to pick up any objects which might be captured between the support foot and lever arm.

Those skilled in the art will appreciate that the above described preferred embodiments are subject to numerous modifications and adaptations without departing from the scope and spirit of the invention. Therefore, it is to be understood that, within the scope of the appended claims the invention may be practiced other than specifically described herein.

What is claimed is:

1. A cane comprising:

an elongated hollow body having a first end and a second end and comprising two telescoping tubular members;

a handle secured to said first end;

the second end having a support foot thereon and a rotatable lever arm carried therein;

a reciprocating trigger means mounted in said elongated body adjacent said handle;

connecting means mounted internally of said elongated hollow body between said reciprocating trigger means and said rotatable lever arm, whereby reciprocating movement of said reciprocating trigger means will rotate said rotatable lever toward and away from said support foot;

means for adjusting the length of said elongated hollow body between said two telescoping tubular members and comprising a spring biased button selectively captured in a plurality of openings formed in a lower of said two telescoping members; and means for adjusting the length of said connecting means comprising an opening in said spring biased button for capturing and holding a stretchable portion of said connecting means.

2. The cane of claim 1 wherein said rotatable lever has a starting position wholly contained in a slotted opening formed in said elongated hollow body.

3. The cane of claim 2 wherein said rotatable lever includes a resilient gripping end which is movable from said starting position entirely in said slotted opening to an operating position outside of said elongated hollow against said support foot.

4. The cane of claim 3 wherein said connecting means is a cable having two ends with a first of said two ends secured in said elongated body, above said trigger means toward a handle, and a second of said two ends secured to said rotatable lever.

5. The cane of claim 4, further including a plurality of pulleys rotatably secured in said elongated body, over which said cable passes.

6. The cane of claim 1 wherein said rotatable lever arm includes a gripping end and a pivoting end, and has a starting position wholly contained in an opening formed in a lower of said two telescoping members, at said second end of said elongated hollow body.

7. The cane of claim 1 wherein said gripping end of said rotatable lever includes a soft resilient tip.

8. The cane of claim 1 wherein said rotatable lever includes a gripping end which is movable from said starting position entirely within said cane in said slotted opening, to an operating position outside of said elongated hollow against said support foot.

9. The cane of claim 8 wherein said connecting means is a cable extending over a plurality of pulley means.

10. A cane comprising:

an elongated hollow body comprised of a top tubular member slidingly mounted with respect to a bottom tubular member;

a spring biased button held between said top tubular member and paid bottom tubular member;

a handle secured to an end of said top tubular member, away from said bottom tubular member;

a slotted opening formed in said bottom tubular member, above a support foot secured to an end of said bottom tubular member, away from said top tubular member;

a trigger slidably mounted in said top tubular member adjacent to said handle;

a gripping means rotatably mounted about a pivot in said slotted opening;

an adjustable cable means mounted internally of said top tubular member and said bottom tubular member; said adjustable cable means having two ends with a first of said two ends secured in said top tubular member and a second of said two ends secured to said rotatable lever; and means for adjusting the length of said adjustable cable means comprising a stretchable portion of said cable means captured in an opening formed in said spring biased button.

11. The cane of claim 10 wherein said gripping means comprises a rotatable lever having a resilient tip.

12. The cane of claim 10, further including means for adjusting the length of said elongated body comprised of said spring biased button selectively captured in a plurality of openings formed in said bottom tubular member.

13. The cane of claim 12 wherein said gripping means comprises a rotatable lever having a gripping end which is movable from a starting position entirely within said slotted opening, to an operating position outside of said bottom tubular member against said support foot.

14. The cane of claim 13 wherein said adjustable cable means extends over a plurality of pulley means.

15. A cane comprising:

an elongated hollow body comprised of a top tubular member telescopingly mounted in a bottom tubular member, with means for adjusting the length of said elongated hollow body mounted between the two telescoping tubular members including a spring biased button having an opening therethrough;

a handle secured to an end of said top tubular member, away from said bottom tubular member;

a slotted opening formed in said bottom tubular member, above a support foot secured to an end of said bottom tubular member, away from said top tubular member;

a trigger slidably mounted in said top tubular member adjacent to said handle and having a pulley means associated therewith;

a lever arm having a gripping end and a pivot end rotatably mounted about a pivot in said slotted opening; and adjustable cable means mounted internally of said top tubular member and said bottom tubular member; said adjustable cable means having two ends, a first of said two ends secured in said top tubular member and having a stretchable portion passing through and being captured in said opening in said spring biased button; and a second of said two ends secured to said rotatable lever with said adjustable cable means extending over said pulley means associated with said trigger means and two further pulleys mounted internally of said elongated hollow body.

* * * * *